US006471061B1

(12) United States Patent
Teague et al.

(10) Patent No.: US 6,471,061 B1
(45) Date of Patent: Oct. 29, 2002

(54) UNITIZED PACKAGE FOR INSULATION PRODUCTS

(75) Inventors: Jo M. Teague, Littleton, CO (US); Donald I. Stuart, Innisfail; Murray G. Line, Winnipeg, both of (CA)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/697,255

(22) Filed: Oct. 26, 2000

(51) Int. Cl.[7] ..... B65D 71/08
(52) U.S. Cl. ..... 206/497; 206/597; 206/442
(58) Field of Search ..... 206/442, 499, 206/597, 386, 83.5, 497

(56) References Cited

U.S. PATENT DOCUMENTS 4,332,326 A * 6/1982 Kelly et al. ..... 206/497
RE31,191 E * 3/1983 Connolly ..... 206/386
5,515,973 A * 5/1996 Sharp ..... 206/497
5,725,089 A * 3/1998 Ravet et al. ..... 206/83.5

* cited by examiner

*Primary Examiner*—David T. Fidei
(74) *Attorney, Agent, or Firm*—Robert D. Touslee

(57) ABSTRACT

A unitized package contains a stack of insulation containing packages. The unitized package is formed by a sheet of stretch wrap film that is spirally wrapped about the sides and at least partially overlays the upper and lower surfaces of the stack of insulation containing packages to hold the stack of packages together as a packaged unit. The unitized package has a band adjacent the base of the unitized package which forms a loop adjacent one side of the unitized package to which a pulling means can be secured to pull the unitized package over a horizontal surface, such as a warehouse floor or truck cargo bed, to facilitate moving the unitized package or unloading the unitized package from the truck.

11 Claims, 1 Drawing Sheet

UNITIZED PACKAGE FOR INSULATION PRODUCTS

BACKGROUND OF THE INVENTION

The present invention relates to a unitized package for a stack of insulation containing packages, and, in particular, to a unitized package for a stack of insulation containing packages which has a band adjacent to a base of the unitized package to facilitate the pulling of the unitized package over a horizontal surface, such as but not limited to the cargo bed of a truck.

Insulation containing packages, such as packages of glass fiber blowing wool or other forms of loose blown insulation, batts of glass fiber or other insulation materials, and rolls of glass fiber or other insulation materials, are spirally wrapped in sheets of stretch wrap film to form unitized packages for storage and shipment to job sites. These unitized packages typically weigh from about 90 pounds to about 1600 pounds, have a height from about 45 inches to about 108 inches, a width from about 33 inches to about 57 inches, and a length from about 37 inches to about 57 inches.

Do to their size and weight, these unitized packages are not easily moved about by hand and it generally requires the efforts of two or more workmen to move or unload these unitized packages from a cargo bed by hand. In addition, moving these unitized packages by hand is time consuming and, if the unitized packages are not properly handled, there is a risk of strain or other injury to the workmen. Generally, the size and weight of the unitized packages does not present a problem in warehouses or on loading docks where clamp and/or fork lift trucks can be used to move the unitized packages about the warehouse and to load the unitized packages into or unload the unitized packages from a truck. However, at job sites or other locations where loading docks and/or clamp trucks are not available and the unitized packages must be moved by hand, the unitized package does pose a handling problem. Thus, there has been a need to facilitate the handling these heavy and bulky unitized packages and, especially, the unloading of these heavy and bulky unitized packages from trucks, at locations where a clamp truck or similar equipment is not available or can not be driven into the truck, to reduce the amount of time and manpower required to handle the unitized packages and to reduce the chance of injury due to the mishandling of the unitized packages.

SUMMARY OF THE INVENTION

The unitized package of the present invention solves the problems currently encountered when handling unitized packages by providing a unitized package that can be easily moved or unloaded from the cargo bed of a truck, without the need for a clamp truck or loading dock, by securing a line such as a rope, strap or cable to a loop formed adjacent the bottom of the unitized package and pulling the unitized package across a floor or cargo bed with a fork lift truck, winch, or similar pulling means.

The unitized package of the present invention contains a stack of insulation containing packages, e.g. thirteen layers of packages with three packages to a layer. The insulation within the packages is typically a conventional building insulation, such as but not limited to glass fiber building insulation. For example, the packages within the unitized package may contain glass fiber blowing wool or other loose fill insulation, batts of insulation (such as but not limited to batts of glass fiber insulation), or rolls of insulation (such as but not limited to rolls of glass fiber insulation). The unitized packages of the present invention are heavy and bulky and typically weigh from about 90 pounds to about 1600 pounds, have a height from about 45 inches to about 108 inches, a width from about 33 inches to about 57 inches, and a length from about 37 inches to about 57 inches.

The unitized package is formed by a sheet of stretch wrap film that is spirally wrapped about the sides and at least partially overlays the upper and lower surfaces of the stack of insulation containing packages to hold the stack of packages together as a packaged unit. The unitized package has a band adjacent the base of the unitized package which forms a loop adjacent one side of the unitized package to which a rope or other pulling means can be secured to pull the unitized package over a horizontal surface, such as a warehouse floor or truck cargo bed. Preferably, the band is formed of a plurality of additional wraps of the sheet of stretch wrap film which are wrapped about the sides of the unitized package adjacent the base of the unitized package and overlay each other. The loop formed by the band has a tensile strength adapted to be less than the tensile strength of a rope, strap or other pulling means to be connected to the loop whereby the loop will fail prior to the rope or other pulling means connected to the loop to prevent the rope or other pulling means from snapping when pulling the unitized package across a floor or cargo bed. By locating the loop adjacent the base of the unitized package, the unitized package can be pulled across a floor or cargo bed without reducing the stability of the unitized package and tipping unitized package over.

The unitized package of the present invention may also have a tray or layer of sheet material, such as but not limited to a paperboard tray or sheet, located intermediate the lower surface of the stack of insulation containing packages and the portion of the sheet of stretch wrap film overlaying the lower surface of stack of insulation containing packages to protect the packages from abrasion when being pulled across a floor or cargo bed.

DESCRIPTION OF THE PREFERRED EMBODIMENTS

Figure 1:
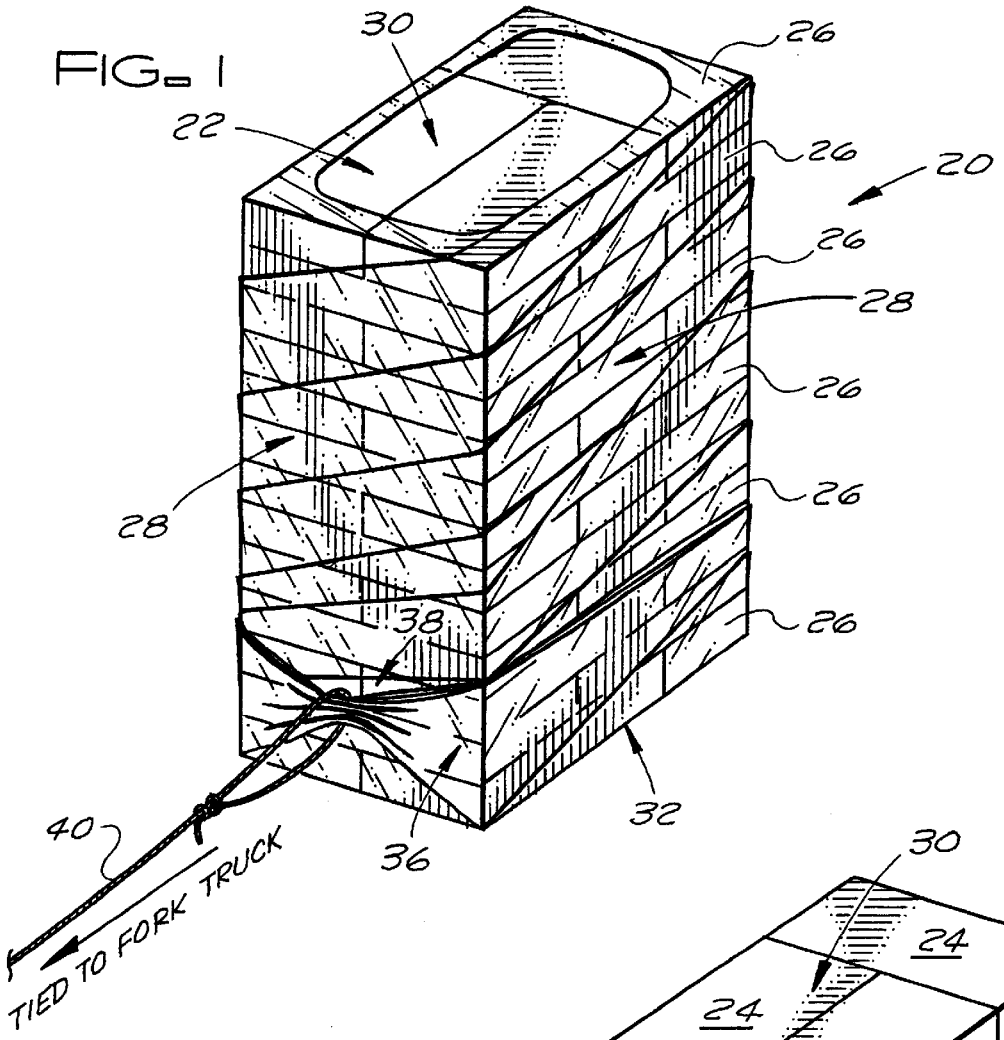
FIG. 1 is a schematic perspective view of the unitized package of the present invention with a rope secured to the loop of the unitized package.
Figure 2:
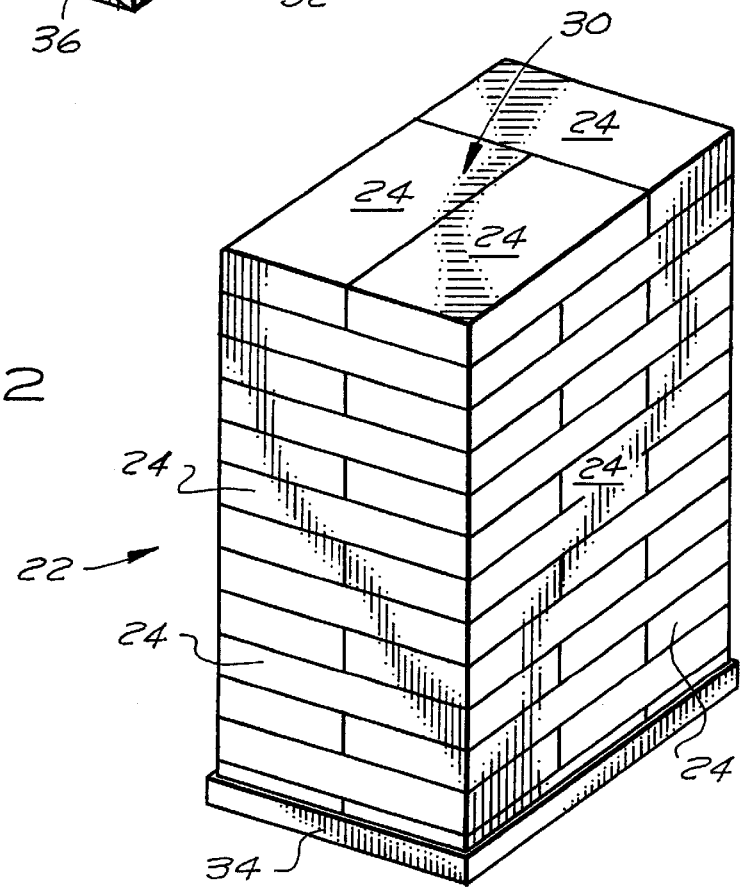
FIG. 2 is a schematic perspective view of a typical stack of insulation containing packages, with a slip sheet or tray, that is packaged within the unitized package of the present invention.

As shown in FIGS. 1 and 2, the unitized package 20 of the present invention contains a stack 22 of insulation containing packages 24, e.g. thirteen layers of packages with three packages to a layer. The insulation within the packages 24 is typically a conventional building insulation, such as but not limited to glass fiber building insulation. For example, the packages 24 within the unitized package 20 may contain glass fiber blowing wool or other loose fill insulation, batts or sheets of insulation (such as but not limited to batts of glass fiber insulation), or rolls of insulation (such as but not limited to rolls of glass fiber insulation). The unitized packages 20 of the present invention are heavy and bulky and typically: weigh from about 90 pounds to about 1600 pounds, have a height from about 45 inches to about 108 inches, a width from about 33 inches to about 57 inches, and a length from about 37 inches to about 57 inches. The following three examples of the unitized package 20 weigh from about 180 pounds to about 1400 pounds, have a height from about 45 inches to about 104 inches, a width from about 37 inches to about 47 inches, and a length from about 50 inches to about 55 inches.

A typical unitized package 20 containing packages 24 of glass fiber blowing wool or other loose fill insulation material contains thirty nine packages of insulation arranged in thirteen layers with three packages to a layer. The insulation containing packages 24 each weigh about 36 pounds and are about 37 inches in length by about 18 inches in width by about 8 inches in thickness. Thus, a typical unitized package 20, containing packages 24 of glass fiber blowing wool or other loose fill insulation, weighs about 1400 pounds and is about 55 inches in length by about 37 inches in width by about 104 inches in height.

A typical unitized package 20 containing packages 24 of glass fiber insulation batts or blankets or sheets of other insulation materials contains fifteen packages of insulation arranged in three layers with five packages to a layer. The insulation containing packages 24 each weigh about 30 pounds and are about 50 inches in length by about 9 inches in width (when compressed down by banding for packaging from about 19 inches) by about 15 inches in thickness. Thus, a typical unitized package 20, containing packages 24 of glass fiber insulation batts or blankets or sheets of other insulation materials, weighs about 450 pounds and is about 50 inches in length by about 47 inches in width by about 45 inches in height.

A typical unitized package 20 containing packages 24 of glass fiber insulation rolls or rolls of other insulation materials contains twelve packages of insulation arranged in three layers with four packages to a layer. The insulation containing packages 24 each weigh about 15 pounds and are about 26 inches in length by about 19 inches in width by about 15 inches in thickness. Thus, a typical unitized package 20, containing packages 24 of glass fiber insulation rolls or rolls of other insulation materials, weighs about 180 pounds and is about 52 inches in length by about 38 inches in width by about 45 inches in height.

The unitized package 20 is formed by a sheet 26 of stretch wrap film that is spirally wrapped about the sides 28 and at least partially overlays the upper and lower surfaces 30 and 32 of the stack 22 of insulation containing packages 24 to hold the stack of packages together as a packaged unit. The sheet 26 of stretch wrap film is a conventional, commercially available sheet of polymeric stretch wrap film, e.g. a polyethylene, twenty or thirty inches wide, 1.1 mil sheet. One major surface of the sheet 26 of stretch wrap film may have a tacky, sticky or adhesive surface to bond the sheet 26 to the stack 22 of insulation containing packages 24 and other layers of the sheet wrapped about the stack of insulation containing packages or neither major surface of the sheet 26 of stretch wrap film may have a tacky, sticky or adhesive surface. Where neither major surface of the sheet 26 of stretch wrap film has a tacky, sticky or adhesive surface, static electricity may cause the layers of the sheet 26 wrapped about the stack 22 of insulation containing packages 24 to cling to the stack of packages and to other layers of the wrap and/or the sheet may be secured in place about the stack 22 of insulation containing packages 24 by adhesive tape. A stretch wrap film marketed by Intertape Polymer Group, under the trade designation STRETCH FLEX SSC, is an example of a stretch wrap film which may be used to form the unitized package 20.

The unitized package 20 is formed of spirally wrapped, partially overlapping layers of the sheet 26 of stretch wrap film which are spirally wrapped about the sides 28 of the stack 22 of insulation containing packages 24 and at least partially overlay the upper and lower surfaces 30 and 32 of the stack of insulation containing packages 24, as shown in FIG. 1, or completely cover the upper and lower surfaces 30 and 32 of the stack 22 of insulation containing packages 24 to hold the stack 22 of packages together as a packaged unit. The sheet 26 stretch wrap film may be spirally wrapped from the bottom to the top of the stack 22 and back down to the bottom of the stack 22 again. In the unitized package 20, where a sheet 26 of stretch wrap film is used having a tacky major surface, the tacky surface of the sheet 26 of stretch wrap film forms the inner surface of the sheet and bonds the overlapping lateral edge portions of the spirally wrapped sheet 26 together and the remainder of the sheet to the insulation containing packages within the unitized package 20.

As shown in FIG. 2, the stack 22 of insulation containing packages 24 may rest on a slip sheet 34, such as but not limited to a tray, that is located intermediate the undersides of the packages 24 in the lowermost layer of the stack 22 and the portion of the sheet 26 of stretch wrap film overlaying the lower surface 32 of the stack. Preferably, the slip sheet 34 is made of paperboard or a similar material and protects the undersides of the insulation containing packages 24 in the lowermost layer of the stack 22 from damage due to abrasion as the unitized package 20 is pulled across a floor or cargo bed.

The unitized package 20 has a band 36, adjacent the base of the unitized package 20, which forms a loop 38 adjacent one side of the unitized package to which a rope, strap, cable or other pulling means 40 can be secured to pull the unitized package 20 over a horizontal surface, such as a warehouse floor or truck cargo bed. Preferably, the band 36 is formed of a plurality of additional wraps of the sheet 26 of stretch wrap film (e.g. about five to about eight additional wraps) which are wrapped about the sides of the unitized package 20 at or adjacent the base or underside of the unitized package and overlay each other. The band 36 has a larger peripheral dimension than the horizontal peripheral dimension about the stack 22. This larger peripheral dimension of the band 36 enables the formation of the loop 38 (a loop defined in part by the band and in part by the side of the unitized package) adjacent one side of the unitized package through or to which a rope, strap, cable or other pulling means 40 can be passed and tied or otherwise secured. When the rope, strap, cable or other pulling means 40 is passed through the loop 38, the layers of the sheet 26 forming the loop 38 are generally necked down, as shown in FIG. 1, by grasping the loop 38 by hand and the pulling means is secured to the necked down portion of the loop.

The loop 38 formed by the band 36 has a tensile strength adapted to be less than the tensile strength of a rope, strap, cable or other pulling means 40 to be connected to the loop 38 whereby the loop 38 will fail prior to the rope, strap, cable or other pulling means 40 connected to the loop 38 to prevent the rope, strap, cable or other pulling means from snapping when pulling the unitized package 20 across a floor or cargo bed. For example, where the loop 38 of the band 36 has a tensile strength between 300 psi and 600 psi, the rope, strap, cable or other pulling means should have a tensile strength in excess of 600 psi.

The unitized package 20 has a center of gravity that enables the unitized package to maintain an upright orientation while being pulled over a substantially horizontal surface by exerting a force on the unitized package in a substantially horizontal direction substantially perpendicular to one of the side surfaces of the unitized package adjacent the base of the unitized package. By locating the loop 38 adjacent the base of the unitized package 20, the unitized package 20 can be pulled across a floor or cargo bed without reducing the stability of the unitized package and tipping unitized package 20 over. Preferably, where two sides of the unitized package 20 are longer than the other two sides, the loop 38 is formed adjacent one of the shorter sides of the unitized package for better stability when the unitized package is being pulled across a floor or cargo bed.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A unitized package containing multiple packages of insulation product, comprising:

a stack of insulation containing packages; the stack of insulation containing packages having horizontally extending upper and lower surfaces and vertically extending side surfaces; the stack of insulation containing packages being further packaged as a unitized package within a sheet of stretch wrap film that is spirally wrapped about the side surfaces of the stack and at least partially overlays the upper and lower surfaces of the stack to hold the insulation containing packages forming the stack together as a packaged unit; the lower wrapped surface of the stack of insulation containing packages being a base of the unitized package upon which the unitized package is adapted to rest; the unitized package having a weight of at least 90 pounds; the unitized package having a center of gravity that enables the unitized package to maintain an upright orientation while being pulled over a substantially horizontal surface by exerting a force on the unitized package in a substantially horizontal direction substantially perpendicular to one of the side surfaces of the unitized package adjacent the base of the unitized package; and the unitized package having a band adjacent the base of the unitized package which forms a loop adjacent one of the side surfaces the unitized package to which a pulling means can be secured to pull the unitized package; the band being formed of a plurality of additional wraps of the sheet of stretch wrap film which are wrapped about the unitized package adjacent the base of the unitized package and overlay each other.

2. The unitized package containing multiple packages of insulation product according to claim 1, wherein:

the band has a tensile strength adapted to be less than a tensile strength of a pulling means for pulling the unitized package whereby the band will fail prior to the pulling means.

3. The unitized package containing multiple packages of insulation product according to claim 1, wherein:

a layer of sheet material in located intermediate the lower surface of the stack of insulation containing packages and a portion of the sheet of stretch wrap film overlaying the lower surface of stack of insulation containing packages.

4. The unitized package containing multiple packages of insulation product according to claim 1, wherein:

the unitized package has a height of about 45 inches or greater, a width of about 33 inches or greater, and a length of about 37 inches or greater.

5. The unitized package containing multiple packages of insulation product according to claim 4, wherein:

the band has a tensile strength adapted to be less than a tensile strength of a pulling means for pulling the unitized package whereby the band will fail prior to the pulling means.

6. The unitized package containing multiple packages of insulation product according to claim 5, wherein:

the band has a tensile strength between 300 psi and 600 psi and is adapted to be pulled by a pulling means having a tensile strength greater than 600 psi whereby the band is adapted to fail prior to the pulling means.

7. The unitized package containing multiple packages of insulation product according to claim 4, wherein:

a layer of sheet material in located intermediate the lower surface of the stack of insulation containing packages and a portion of the sheet of stretch wrap film overlaying the lower surface of stack of insulation containing packages.

8. The unitized package containing multiple packages of insulation product according to claim 1, wherein:

the unitized package has a weight of at least 180 pounds, a height of about 45 inches or greater, a width of about 37 inches or greater, and a length of about 50 inches or greater.

9. The unitized package containing multiple packages of insulation product according to claim 8, wherein:

the band has a tensile strength adapted to be less than a tensile strength of a pulling means for pulling the unitized package whereby the band will fail prior to the pulling means.

10. The unitized package containing multiple packages of insulation product according to claim 9, wherein:

the band has a tensile strength between 300 psi and 600 psi and is adapted to be pulled by a pulling means having a tensile strength greater than 600 psi whereby the band is adapted to fail prior to the pulling means.

11. The unitized package containing multiple packages of insulation product according to claim 8, wherein:

a layer of sheet material in located intermediate the lower surface of the stack of insulation containing packages and a portion of the sheet of stretch wrap film overlaying the lower surface of stack of insulation containing packages.

* * * * *